US005082029A

United States Patent [19]

Dornier

[11] Patent Number: 5,082,029

[45] Date of Patent: Jan. 21, 1992

[54] LOOM ARRANGEMENT FOR FABRICS SENSITIVE TO WEAVING STOP MARKS

[75] Inventor: Peter Dornier, Lindau, Fed. Rep. of Germany

[73] Assignee: Lindauer Dornier Gesellschaft mbH, Lindau, Fed. Rep. of Germany

[21] Appl. No.: 593,105

[22] Filed: Oct. 5, 1990

[30] Foreign Application Priority Data

Oct. 7, 1989 [DE] Fed. Rep. of Germany ..... 3933616

[51] Int. Cl.[5] ..... D03C 5/00; D03C 13/00

[52] U.S. Cl. ..... 139/1 E; 139/55.1; 139/79; 139/336

[58] Field of Search ..... 139/79, 80, 81, 82, 139/83, 55.1, 56, 1 E, 337, 336, 116.2

[56] References Cited

U.S. PATENT DOCUMENTS 3,831,637 8/1974 Jullard ..... 139/1 E
4,474,218 10/1984 Sample ..... 139/1 E
4,572,247 2/1986 Speich ..... 139/79
4,724,872 2/1988 Speich ..... 139/1 E

FOREIGN PATENT DOCUMENTS 2090620 7/1982 United Kingdom ..... 139/336

*Primary Examiner*—Andrew M. Falik
*Attorney, Agent, or Firm*—W. G. Fasse

[57] ABSTRACT

A loom for fabrics which are sensitive to loom stopping marks, especially twill fabrics, has a disengagement lever (14) on an eccentric drive mechanism of the loom. The disengagement lever is operated by a controlled driving device, so that it causes all heald frames or shafts of the loom to assume a central shed position when the loom is stopped. Thus, stoppage marks in the fabric are avoided since the heald frames no longer stretch the warp threads during a loom stoppage since the frames are moved to a closed shed position during stoppage.

3 Claims, 2 Drawing Sheets

LOOM ARRANGEMENT FOR FABRICS SENSITIVE TO WEAVING STOP MARKS

FIELD OF THE INVENTION

The invention relates to looms with an eccentric drive and heald frames which are driven through connecting elements by a roller lever with cam follower rollers in contact with a rotating eccentric cam. A disengagement lever is provided, fixed rigidly against rotation to the roller lever, to control the engagement of the cam follower rollers with the eccentric cam.

BACKGROUND INFORMATION

Such eccentric loom drive mechanisms are known and used primarily for the manufacture of simple fabric textures, for example, twill which is sensitive to stoppage marks.

When, due to breakage of the weft or warp thread the loom is stopped either automatically or by hand, some heald frames will stop in the upper shed position because of the type of binding. As a result, the respective warp threads will be stretched. This stretching can subsequently be seen as a defect in the finished fabric as a so-called "Stoppage mark".

So far, it is not known how to reliably avoid such a stoppage mark, except that within a relatively short time after the loom stops, the stretched warp threads are appropriately relieved of tension, which means that the respective heald frame or shaft must be moved toward a center shed position. This procedure up to now, can only be implemented in electronically controlled heald frame or shaft looms, wherein the heald frames or shafts are not moved by fixed associated cams, but rather are connected individually with the eccentric drive mechanism. When such fabrics, however, are made on conventional eccentric drive looms, it is not known how to avoid said stoppage marks.

OBJECTS OF THE INVENTION

In view of the above it is the aim of the invention to achieve the following objects singly or in combination:

to construct an eccentric drive mechanism for a loom as described, so that no stoppage marks occur, or become visible, in the fabric even after prolonged times of stoppage;

to make sure that all heald frames move automatically to a center shed position in response to any stopping of the loom; and to make sure that just prior to resuming a weaving operation all heald frames or shafts are returned into the position they had at the time of stopping the loom, to avoid binding defects in the finished fabric.

SUMMARY OF THE INVENTION

According to the invention the disengagement lever of the eccentric drive mechanism, is connected to a driving device which tilts the disengagement lever, when the machine stops in such a way, that all heald shafts are moved into a central loom shed position.

The disengagement lever normally provided on eccentric drive mechanisms for a manual positioning of the heald shafts into a central shed position is now, in accordance with the invention, connected with a controlled automatic driving device, preferably with a piston rod of an automatically controllable piston cylinder device. A control system operatively connected to the driving device now automatically applies pressure to the driving device as soon as the loom stops. In this way, the driving device causes the disengagement lever to move the heald shafts from an open shed position into a central shed position. Stoppage marks in the fabric are thereby avoided because all heald frames are brought into the central shed position, whereby tension on the warp threads is relieved immediately after the loom stops.

The driving device furthermore is controlled so that shortly before the loom shed starts again, the proper position that the heald frames had at the time of stopping, is restored so as to avoid binding faults in the weave at a new start-up. The control system required for this purpose must first sense the initial position of the disengagement lever prior to the stopping of the loom, then activate the driving device, so that the disengagement lever moves to a position which causes the heald frames to assume a central shed position and, shortly before the start of the loom, the disengagement lever must be moved back to its initial position before the loom was stopped.

The driving device can be embodied in several ways. As mentioned, a hydraulic or pneumatic piston cylinder device is preferred. However, an electromagnet may also be used as a driving device. Furthermore, an electric motor drive can be used. It is only important that the disengagement lever be rotated by the control system through the driving device to the positions as described above.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
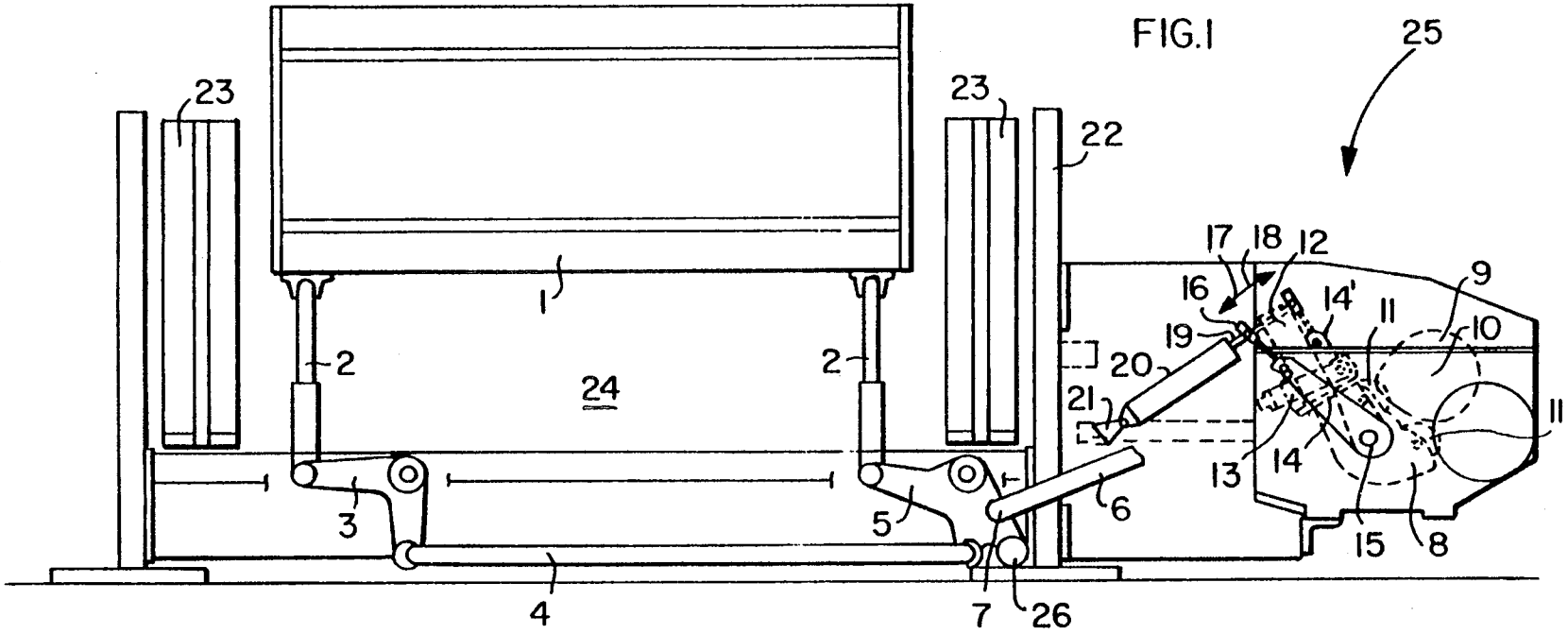
FIG. 1 shows a schematic front view of a loom equipped according to the invention.

The drawing shows a loom 24 with heald shafts 1 driven by an eccentric drive mechanism 25. Two parallel push rods 2 connect the heald shafts 1 with the free end of respective shift levers 3, 5 tied together by a connecting rod 4. Lever 5 is linked to a drive rod 6, the other end of which is secured by a shackle 13 to a roller lever 8 carrying two contact or cam follower rollers 11 engaged with a cam 9. Each of the cams 9 is rotationally driven around an axis 10, however only the forward cam 9 is shown in FIG. 1.

The position of the shackle 13 is adjustable in the longitudinal direction of roller lever 8 and can be fixed for setting different strokes following an adjustment.

An additional adjustment is possible if the rod 6, which normally connects to lever 5 in the hole 7, is connectable to at least on other bore 26 instead of hole 7. The drive rod 6 itself could be adjustable in its length. Such rods as such are known.

A disengagement lever 14 is secured to an axle 15 fixed against rotation around the axle 15. The axle 15 in turn is rigidly connected with the roller lever 8. A handle 16 is provided at the forward, upper end of the disengagement lever 14 for permitting manual rotation of the disengagement lever 14 in the direction of arrows 17, 18.

In accordance with the invention a driving device 20 is attached to the free, movable end of disengagement lever 14. In the example shown the driving device is a pneumatically powered piston cylinder 20 attached to the machine frame at one end by a pivot bearing 21. The piston cylinder device has a piston rod 19, adjustable if desired, attached to the disengagement lever 14. Thus, the position of the disengagement lever 14 is automatically controllable by the action of the piston cylinder 20 in response to a control shown in FIG. 2, whereby the disengagement lever 14 can be rotated in the direction of arrows 17, 18.

With regard to the further structure of the loom it is mentioned that the loom frame has side walls 22 and parallel to each side wall a main gear 23.

During the operation of the loom 24 by the eccentric drive mechanism 25 it is possible that a warp thread or a weft thread breaks and causes an automatic or manual stoppage of the loom.

Figure 2:
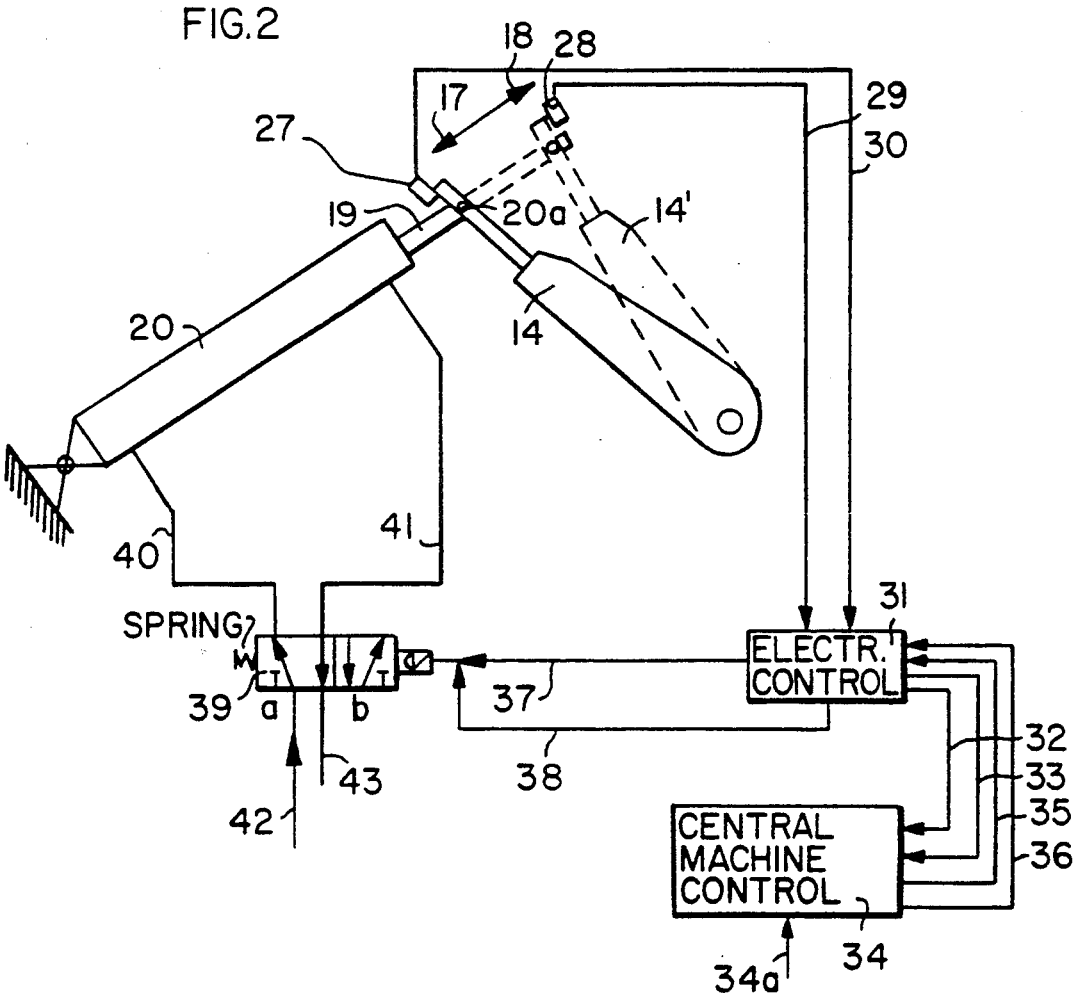
FIG. 2 is a more detailed view of a disengagement mechanism with its automatic driving device and with its control for the driving device.

In accordance with the invention it is provided that the control system shown in FIG. 2 senses the angular position of the disengagement lever 14 at the time of stoppage of the loom. A respective signal is stored in a memory of the control system for use, just prior to restarting of the loom, for restoring the disengagement lever 14 to its angular position it had at the time of stopping. During weaving the angular position of the disengagement lever 14 always remains the same.

When the loom now stops for one or the other reason, the control system for the piston cylinder 20 is activated and the piston rod 19 rotates the disengagement lever 14 in the direction of arrow 18 into position 14', whereby the contact or cam follower rollers 11 are lifted off their cams 9 and all heald frames 1, which were in upper shed position, are brought into a central shed position. Thus, it is assured that the warp threads, which had been under tension from the heald frames in the upper shed position, are relaxed and stoppage marks are avoided, even if the loom 24 is stopped for longer durations.

The roller lever 8 has a protrusion forming a driving rocker arm 12. The above mentioned adjustable shackle 13 is fastened to the rocker arm 12 for achieving varying stroke lengths for the heald frames or shafts.

The present mechanism is only used with eccentric loom drive mechanisms and, because of its low cost of implementation, presents a simple means for avoiding the mentioned undesirable stoppage marks in the fabric. Previously known measures to avoid such stoppage marks, which are applied to the loom itself, are more expensive and more complicated.

Thus, it can be seen that the stoppage marks in the fabric, i.e. light streaks in the direction of the weft, can be avoided which otherwise would occur when the loom remains too long a period in the stopped position. Cause for these stoppage marks is the stretching of the warp threads at the time of stoppage by the added tension applied to the warp threads by the heald frames in their upper shed position while warp threads who's heald frames are in central shed position are not subjected to such additional tension.

Through measures in accordance with the invention it is achieved, that shortly after the loom is stopped those heald frames which were in the upper shed position are brought in a central shed position, so that all warp threads are subject to the same normal warp tension when the machine stands still.

Shortly prior to the start of the loom the heald frames must be brought back to their positions appropriate for the weave so that start-up marks in the fabric are avoided. This is also assured by the arrangement in accordance with the invention.

FIG. 2 shows further details of an electro-pneumatic control for accomplishing the above objects and purposes. The piston cylinder 20 has its piston rod 19 pivoted at **20*a* to an arm of the disengagement lever 14 which can take-up any position between the full line position and the dashed line position 14'. Sensors 27, 28 sense the position of the lever 14 at the time when the loom is stopped. Electrical conductors 29, 30 lead from the position sensors 27, 28 to an electronic control device 31, for supplying position representing electrical signals to the electronic control 31. The electronic control 31 is connected through electrical conductors 32, 33, 35, 36 to the central loom or machine control 34 which includes a conventional central processing unit. Conductors 32, 33 supply the position signal to the central machine control 34**.

When the loom is stopped, e.g. due to a faulty thread, the central machine control 34 receives at its input **34*a* the respective stop signal from a fault sensor (not shown) The central machine control 34 supplies the stop signal through electrical control conductors 35, 36 to the electronic control 31 which in turn provides a control signal to a 5/2-way valve 39 or rather to the magnetic drive of valve 39. This control signal passes through one of the electrical conductors 37 or 38 depending on the sensed position of the lever 14**.

In the shown position "a" of the valve 39 the cylinder receives fluid under pressure through conduits 40, 42 with a return flow through conduits 41, 43, whereby the piston rod **20*a* moves the disengagement lever 14 in the direction of the arrow 18. In position "b" of the valve 39 fluid under pressure is supplied through conduits 41, 42 and return flow is through conduits 40, 43. This control of the position of the lever 14 makes sure that the lever is returned into its previous position just before the loom is restarted. In other words, even if the lever 14 is brought into a central shed position due to a loom stoppage caused by a fault, the lever 14 is returned to the position it had at the time the loom was stopped, when the loom is restarted. The loom starts when the lever 14** has assumed its previous position.

Although the invention has been described with reference to specific example embodiments it will be appreciated that it is intended to cover all modifications and equivalents within the scope of the appended claims.

What is claimed is:

1. A loom (24) comprising an eccentric drive mechanism (25) for operating said loom, heald means for shedding warp threads, said drive mechanism including rotating cam drive means and connecting elements including a roller lever (8) with cam follower rollers (11) normally in contact with said rotating cam drive means (9), a disengagement lever (14) fixed rigidly against rotation to said respective roller lever (8) for controlling an engagement of said rollers (11) with said cam drive means (9), automatic driving means (19, 20) connected to said disengagement lever (14) and responsive to a loom stoppage for rotating said disengaging lever (14) to disengage said cam follower rollers from said cam drive means and for moving all heald means (1) into a central shed position for removing the stress or stretch from said warp threads when said loom is stopped which occurs when the healds are in an open shed position.

2. The loom of claim 1, wherein said automatic driving means is a piston-cylinder unit (19, 20) operatively connected to a free end of said disengagement lever (14) and to a machine frame.

3. The loom of claim 2, further comprising automatic control means for said automatic driving means (19, 20), said automatic control means including sensor means responsive to a loom stopping for rotating said disengagement lever (14) after said loom stops, from a first position to a second position, and further means for automatically bringing said disengagement lever (14) back to said first position before said loom starts operating again.

* * * * *